United States Patent [19]

Gayle et al.

[11] Patent Number: 4,747,884

[45] Date of Patent: May 31, 1988

[54] HIGH STRENGTH ALUMINUM-BASE ALLOY CONTAINING LITHIUM AND ZIRCONIUM AND METHODS OF PREPARATION

[75] Inventors: Frank W. Gayle, Cambridge; John B. Vander Sande, Newbury, both of Mass.

[73] Assignee: Massachusetts Institute of Technology, Cambridge, Mass.

[21] Appl. No.: 719,446

[22] Filed: Apr. 3, 1985

[51] Int. Cl.[4] ..... C22F 1/04

[52] U.S. Cl. ..... 148/2; 148/3; 148/11.5 A; 148/11.5 P; 148/12.7 A; 148/415; 148/437; 420/902

[58] Field of Search ..... 420/552, 902; 148/2, 148/3, 11.5 A, 11.5 P, 12.7 A, 415, 437

[56] References Cited

PUBLICATIONS

Wadsworth, J. et al, *Scripta Metallurgica,* vol. 18, pp. 387–392 (1984).

Wadsworth, J. et al, eds. Aluminum–Lithium Alloys II, TMS–AIME, Monterey, Calif. (1984).

Lederich, R. J. et al, eds. Aluminum–Lithium Alloys II, TMS–AIME, Monterey, Calif. (1984).

Palmer, G. et al, eds. Aluminum–Lithium Alloys (1981).

Sanders, T. H. et al, Acta Metall. vol. 33:927–939 (1982).

Sanders, T. H. NASC Final Report, excerpt from (1979).

*Primary Examiner*—Richard O. Dean

*Attorney, Agent, or Firm*—George W. Neuner; Ronald I. Eisenstein

[57] ABSTRACT

Novel Al-Li-Zr alloys of the formula $Al_{bal}Li_bZr_c$ wherein "b" is about 1.9 through about 4.5 weight percent and "c" is about 0.70 through about 4.0 weight percent are disclosed. These alloys can be formed by mixing Al alloy, Li alloy and Zr alloy, heating to high temperatures and rapidly cooling, followed by heat treatment.

24 Claims, 2 Drawing Sheets

HIGH STRENGTH ALUMINUM-BASE ALLOY CONTAINING LITHIUM AND ZIRCONIUM AND METHODS OF PREPARATION

The Government has rights in this invention pursuant to Grant Number 81-19295-A04-DMR awarded by the National Science Foundation.

BACKGROUND

This invention relates to novel Al—Li—Zr alloys having high strength, high elastic modulus, low-density, good corrosion resistance and good ductility. Methods of forming these novel alloys are also disclosed.

Aluminum-lithium alloys containing up to 3.5 wt % lithium have been the subject of much research in recent years (Sanders, T. H., Jr., et al., eds. *Aluminum-Lithium Alloys, TMS-AIME,* Warrendale, PA (1981)). The interest in these alloys arises from the dramatic increase in elastic modulus and decrease in density associated with the addition of lithium to aluminum. In addition, with appropriate heat treatment, metastable δ' ($Al_3Li$) precipitate available in these alloys affords considerable strengthening. However, these alloys also exhibit low ductility and fracture toughness, which severely limits their commercial application.

A primary factor in the loss of toughness is slip localization which occurs as a result of work-softening on certain slip planes during deformation. The shearable nature of the δ' precipitate and consequent decreased resistance to dislocation slip on planes containing the sheared δ' is considered to be responsible for this behavior (Sanders, T. H., Jr., et al Acta Metall. 30, 927 (1982) and Sanders, T. H., Jr., *Factors Influencing Fracture Toughness and Other Properties of Aluminum-Lithium Alloys,* Naval Air Development Center (1979)).

It would therefore be desirable to have an Al—Li-base alloy which retains the superior characteristics of Al—Li alloys but also possesses high ductility and fracture toughness.

SUMMARY OF THE INVENTION

It has now been discovered that it is possible to incorporate high levels of zirconium, Zr, about 1 weight percent into an Al—Li alloy and create novel Al—Li—Zr which do not suffer the defects of the prior Al—Li alloys while also retaining their advantages. These Al—Li—Zr alloys comprise about 1.9 through 4.5 weight percent Li, 0.7 through 4.0 weight percent Zr with the balance being Al. A method of forming these alloys is described which includes the following steps:

(1) mixing Al metal with Li and Zr alloy;

(2) heating the mixture in an inert gas atmosphere to a temperature sufficient to dissolve the Zr and Li in the molten Al; and (3) rapidly cooling the mixture into a solidified mass.

DETAILED DESCRIPTION

Figure 1A:
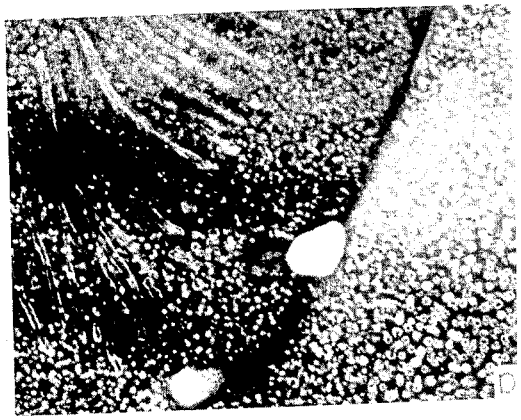
FIG. 1 is a micrograph showing steps in the aging process wherein the alloy has been heat treated at 500° C. for 2 hours, water quenched and aged at 190° C. for (a) 0.25 hour, (b) 4 hours and (c) 32 hours. These are transmission electron microscope (TEM). δ' superlattice darkfield images.

After extensive research, novel alloys, containing at least about 1 weight percent Zr, based on the total weight of the product, have now been created which display high ductility and fracture toughness as well as a high elastic modulus and a low density. Although Al—Li alloys containing about 0.1 weight percent of Zr are known, these alloys do not show the improvement in ductility and fracture toughness exhibited by the present Al—Li—Zr alloys. Rather, the small amount of Zr used is included because it very effectively inhibits recrystallization during hot-working and solution heat treatment. Other Al—Li—X ternary alloys have been proposed which include greater amounts of Zr, or alternatively other elements such as Cu, Mn, Fe+Ni, and Fe+ Co. However, problems were reported with the Zr alloy (Palmer, I. G., et al, in *Aluminum-Lithium Alloys,* supra).

Aluminum has low solubility for zirconium in the solid state as well as in the liquid state at normal casting temperatures. However, by use of the procedures described herein it is possible to create Al—Li alloys containing high levels of Zr. The alloys disclosed herein contain at least about 1.0 weight percent zirconium. The Zr level can range from about 0.7 through 4.0 weight percent, more preferably about 0.9 through 2.0 weight percent and most preferably about 0.9 through 1.5 weight percent.

The Al.Li alloys that the Zr is added to can contain about 1.9 through 4.5 weight percent Li, based on the weight of the total Al.Li.Zr alloy. More preferably one would use about 2.0 through 3.5 weight percent, most preferably about 2.0 through 2.5 weight percent.

The aluminum-base alloys disclosed herein may be represented by the forumula $Al_{bal}Li_bZr_c$ wherein "b" is about 1.9–4.5 weight percent and "c" is about 0.7–4.0 weight percent. Preferably "b" is about 2.0–3.5, more preferably "c" is about 2.0–2.5. Preferably "c" is about 0.9–2.0 weight percent, more preferably "c" is about 0.9–1.5.

Commercial quality Al alloy can be used to prepare the Al-base alloy. However, for best results the resultant alloy should contain very low levels of impurities such as iron and silicon. Preferably not more than about 0.3 weight percent iron and not more than about 0.3 weight percent silicon. It is more preferred to have less than 0.15 weight percent iron and less than 0.15 weight percent silicon are used. Hafnium, Hf, is an impurity sometimes associated with Zr, and the present Al.Li.Zr alloys will show good characterics with up to about 0.5 weight percent of Hf. It is preferred that less than 0.1 weight percent of Hf is used.

The resultant Al—Li—Zr has a novel microstructure which affects the dispersion of slip during deformation. In the alloy, Al—2.34Li—1.07Zr (wt.%), an extremely fine distribution of $Al_3(Li, Zr)$ serves as a preferred nucleation/growth site for δ'. The resulting "composite" precipitate" can be controlled by appropriate heat-treatment. The generally non-shearable nature of the $Al_3(Li, Zr)$ phase precludes the intense slip localization of binary alloys. In addition this alloy should exhibit superplastic behavior.

The precipitate can be represented by the formula $Al_3(Li_xZr_{1-x})$, $1>x\geqq 0.1$. The larger the value of x, the greater the volume fraction $Al_3(Li, Zr)$ is available for dispersion of slip. Precipitates with values of x less than 1.0 should provide greater resistance to dislocation shearing and concomitant slip localization than is provided by the δ' precipitate. Although any $1.0>x\geqq 0.1$ should provide superior results to that obtained with typical Al.Li alloys, "x" is preferably greater than about 0.2, and less than about 0.8, more preferably greater than about 0.4 and less than 0.8.

The alloy is prepared from aluminum metal, lithium and zirconium, preferably via high purity aluminum, high purity Al—Li master alloy and high purity Al—Zr master alloy. This mixture is then heated to a high temperature sufficient to dissolve the Zr in the Al melt, preferably above 900° C. in an inert atmosphere. The mixture is rapidly cooled to retain the Zr in solid solution, at a rate of at least $10^{2°}$ C./sec, preferably at least $10^{3°}$ C./sec (Ohashi, T. et al., *Met. Trans. A.*, 12A: 546 (1981)). Any method of rapid solidification well known in the art can be used. One method of rapid cooling is inert gas atomization. Other methods would include melt quenching and melt spinning.

When inert gas atomization is used, a controlled consolidation process using appropriate heat treatment must then be utilized to retain as much as possible of the Zr in solid solution. It is best to carry out this subsequent processing at the lowest practical temperature.

A heat treatment is generally necessary to put Li that has precipitated out of the Al.Li.Zr solution back into solution. The person of ordinary skill in the art will be able to determine by techniques well known in the art whether the system of rapid solidification selected will require heat treatment of the resulting Al.Li.Zr alloy to return Li to a solid solution in the alloy.

Heat treatment will also control the distribution of $Al_3(Li_{1-x}Zr_x)$ precipitate. A heat treatment below about 550° C. is preferred. The heat treatment can control the value of "x". The exact value for "x" will vary depending upon the particular alloy composition and thermal treatment used. Thus a heat treatment of an Al.2.3-4Li.1.07Zr alloy at 580° C. for 15 hours will result in a "x" of about 0.2, while a heat treatment of between 450°-550° C. for ½ to 24 hours will yield an "x" of about 0.6.

In order to rapidly solidify a metal, at least one dimension will be relatively thin. When a material having greater thickness in that dimension is desired, the rapidly solidified mass may be consolidated. When using inert gas atomization the Al—Li—Zr solidified mass can be vacuum-hot-compacted into a billet. Preferably, this procedure is carried out at about 340° C. at about 20,000 psi. The solidified mass is made into a billet of as great a density as possible.

The billet can then be extruded and heat-treated as desired depending upon the particular end use.

Extrusion and/or compaction should be carried out at temperatures below 550° C., preferably below 450° C. Most preferably compaction is carried out at temperatures below about 350° C. and extrusion is carried out at temperatures between about 200°-350° C.

The resulting alloy unlike Al.Li alloys will provide good mechanical properties without aging. However, the alloy can be aged to provide specific mechanical properties. The specific properties provided by the aging follow the trend for Al.Li alloys, and the person of ordinary skill can select an aging system based upon criteria well known in the art. Preferably, aging is carried out between about 140° C.-240° C., more preferably about 180° C.-200° C.

The invention will be further understood with reference to the following illustrative embodiments, which are purely exemplary, and should not be taken as limiting the true scope of the present invention, as described in the claims.

EXAMPLE 1

The Al.Li.Zr alloy was prepared from high purity aluminum, 20 w/o Li master alloy and 6 w/o Zr master alloy. To obtain the desired 1% Zr solid solution, inert gas atomization at 960° C. was used. The expected cooling rate is approximately $10^{3°}$ C./sec., which is sufficient to retain the zirconium in solid solution. The powder was analyzed to be Al.2.34Li.1.07Zr.

To retain the zirconium in solid solution, subsequent processing was carried out at the lowest practical temperatures. Powder (−100 mesh) was vacuum-hot-compacted at 340° C. at 138,000 kPa (20,000 psi) into a 6.3 cm×~15 cm billet at ~98% of theoretical density. The billet was extruded to a 1.27 cm diameter rod at a 25:1 extrusion ratio. The billet temperature was 260° C., although heating during extrusion brought the extrusion up to 425° C. upon exiting from the press.

Sections of extruded rod were heat-treated at 500° C. from 10 minutes to 24 hours (10 minute treatment in air, others in argon) followed by a water quench. Subsequent aging was carried out at 190° C., using Rockwell B hardness to determine aging curves.

Samples for TEM and STEM were prepared using standard techniques (electropolished in 30 w/o $HNO_3$ in $CH_3OH$, T=30° C., V=12.5 volts, I=0.65-0.95 A/cm$^2$) and examined using a JEOL 200CX transmission electron microscope and a Vacuum Generators HB-5 Scanning Transmission Microscope.

RESULTS

The heat treatment at 500° C. had two primary effects: the solutionizing of lithium and the precipitation of a Zr-rich phase, believed to be $Al_3(Li, Zr)$. The specific characteristics of the precipitate formed are discussed in Gayle, F. W., et al, *Scr. Metall.*, 18: 473 (1984) which is incorporated herein. Precipitation serves as a driving force for grain boundary migration.

Although not wanting to be bound by theory, it is believed that the novel Al—Li—Zr alloys display their superior characteristics for the following reasons. While the precipitation at high temperature in the present Al—Li—Zr system bears strong resemblance to that in the Al—Zr system reported by Nes (Nes, E., et al, *Scr. Metall.*, 5: 957 (1971); Nes, E. et al., *Acta Metall.*, 25:

1039 (1977)), the actual precipitates are not $Al_3Zr$ but $Al_3(Li, Zr)$. These results suggest that an entirely different precipitate from Nes has been obtained.

The precipitates may consist of rods approximately 6 nm in diameter, which are aligned so as to show the pathlines of grain boundary or subgrain boundary motion. This structure is seen in a number of grains in the as-extruded condition due to precipitation during dynamic recovery. Additional precipitation appears to occur during subsequent high temperature heat treatment (e.g. 500° C.) by means of boundary migration due to continued recovery, early stages of recrystallization and/or precipitation-induced grain boundary migration. Regions where the discontinuous reaction does not occur remain supersaturated with Zr, enabling precipitation of $Al_3(Li, Zr)$ as discrete spherical particles with continued heat treatment.

Subsequent aging treatment at 190° C. results in precipitation of δ' (which has the same $Ll_2$ structure as metastable $Al_3Zr$) at the $Al_3(Li, Zr)$—aluminum interface. This can be interpreted as a preferred nucleation and growth at δ' at the interface such that the interface is completely wetted. The $Al_3(Li, Zr)$ has approximately +1% lattice mismatch with the matrix while δ' has a −0.08% mismatch. Thus reduction of elastic strain energy is a driving force for preferred precipitation at the $A_3(Li, Zr)$—Al interface.

Figure 1B:
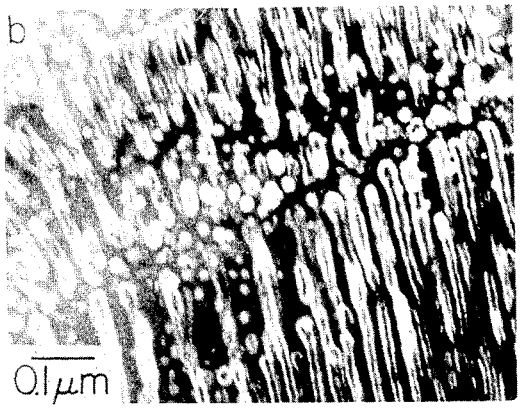
Figure 1C:
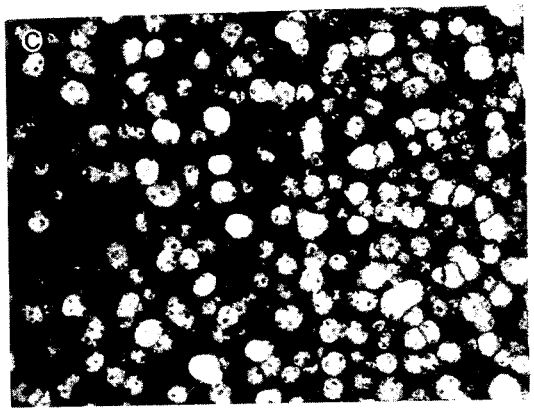
Figure 2A:
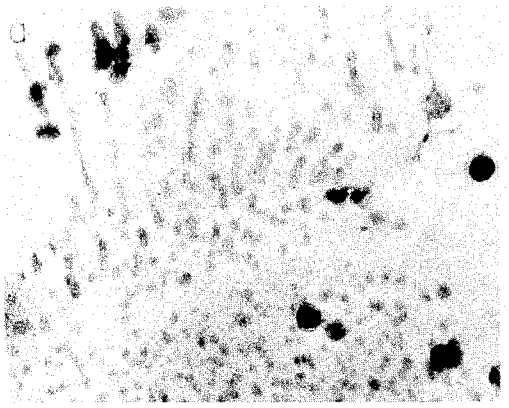
FIG. 2 is a micrograph showing "$Al_3(Li_xZr_{1-x})$" distribution at various steps in the aging process wherein the alloy has been heat treated at 500° C. for 24 hours and aged at 190° C. for (a) 0 hours, (b) 0.25 hours, (c) 4 hours and (d) 32 hours. Bright field TEM (a) and δ' superlattice darkfield (b,c,d) images.
Figure 2B:
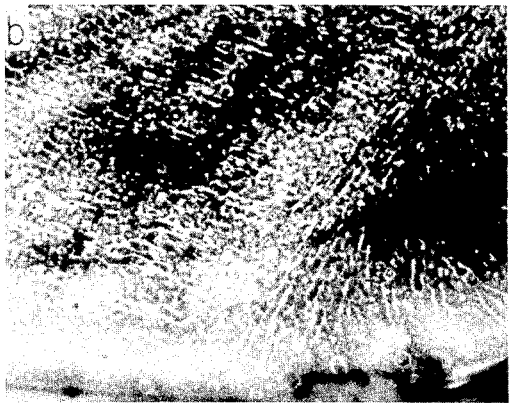
Figure 2C:
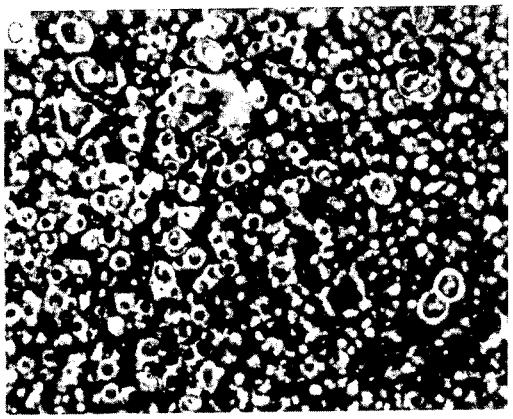
Figure 2D:
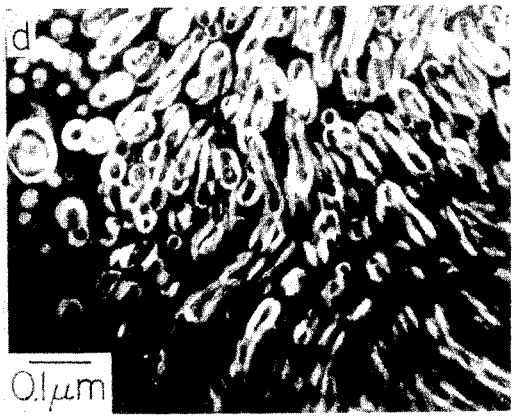

FIG. 1 shows steps in the aging process which indicate the increased δ' "envelope" diameter with aging time, both in the discontinuous precipitation product and in the case of discrete spherical precipitates.

Longer solution heat treatments resulted in a coarser $Al_3(Li, Zr)$ distribution (FIG. 2). The discontinuous reaction product is increasingly agglomerated with a lower aspect ratio for individual precipitates. The discrete spherical precipitates also Ostwald ripen. Precipitation behavior of δ' remains similar to those alloys with short 500° C. heat treatments, in that δ' precipitates at the $Al_3(Li, Zr)$-matrix interface (FIG. 2). It has been seen that more δ' precipitates independently of $Al_3(Li, Zr)$, due to the decreased availability of $Al_3(Li, Zr)$-matrix interfacial area as a preferred site.

Energy dispersive X-ray analysis in STEM shows the precipitates to be Zr-rich and the matrix and δ' "envelopes" to be of approximately equivalent, very low Zr levels. However, it is easily seen in FIGS. 1 and 2 that the $Al_3(Li, Zr)$ core is not imaged when using an 001 superlattice reflection. In contrast $Al_3Zr$ precipitates in Al—Zr binary alloys image strongly using superlattice reflections (Nes, supra *Acta Metal*).

The low level of electron scattering by the "$Al_3(Li, Zr)$" into the superlattice reflection are explained by the incorporation of Li onto the Zr-sublattice in the $Al_3Zr$ phase resulting in $Al_3(Li, Zr)$. Since the atomic scattering factors increase in the order Li, Al, Zr, the ternary phase thus formed would have decreased superlattice scattering. In fact, a precipitate of composition close to $Al_3(Li_{0.6}Zr_{0.4})$ would have $F_{001} \cong 0$, where $F_{001}$ is the structure factor for the 001 reflection.

In some cases with longer 500° C. heat treatments the $Al_3(Li, Zr)$ precipitates can be imaged, albeit weakly using superlattice reflections. This may be due simply to the increased thickness of precipitate.

EXAMPLE 2

An Al.Li.Zr alloy of the composition $Al_{bal}Li_bZr_c$ where "b"=2.19 weight percent and "c"=0.12 weight percent (Al.2.19Li.0.12Zr) was prepared following the same procedures as set forth in Example 1.

The alloy of Example 1 (Al.2.34Li.1.07Zr) and the present alloy were then aged for varying times as indicated and tested for tensile strength, yield strength and elongation using standard procedures well known in the art. Longitudinal test specimens for the 0.5" rod were 0.350" diameter round tensile bars with a gage length of 1.75 inches. Longitudinal and transverse tensile properties on the rectangular extrusion were measured using 0.113" rounds with a gage length of 0.45 inches. The value of elongation-to-failure was recorded for each test. The results for the alloy of Example 1 are set from in Table 1.

TABLE 1

| SHT* | AGE | UTS[a] | YS[b] | E[c] |
|---|---|---|---|---|
| | Al.2.34Li.1.072Zr | | | |
| Rod | | | | |
| 500° C./1 hr. | + 0 hrs. | 54.4 | 46.1 | 14.3 |
| | + 180° C./0.25 hr. | 56.2 | 48.2 | 13.6 |
| | + 190° C./1 hr. | 70.9 | 68.0 | 5.71 |
| | + 190° C./16 hr. | 61.8 | 55.0 | 7.14 |
| 450° C./1 hr. | + 180° C./10 m. | 67.8 | 65.4 | 7.14 |
| | + 190° C./1 hr. | 73.7 | 71.9 | 5.71 |
| 580° C./12 hr. | + 190° C./2 hr. | 64.7 | 61.6 | 2.86 |
| Rod** | | | | |
| 500° C./1 | + 180° C./.25 hr. | 60.0 | 52.2 | 10.7 |
| | + 190° C./1 hr. | 73.5 | 70.7 | 5.0 |
| | Al.2.19Li.0.12Zr | | | |
| Rod | | | | |
| 500° C./1 hr. | + 0 hrs. | 34.2 | 21.0 | 17.1 |
| | + 190° C./0.5 hr. | 52.1 | 45.4 | 6.43 |
| | + 190° C./2 hr. | 57.6 | 52.6 | 4.29 |
| | + 190° C./24 hr. | 48.7 | 39.8 | 7.86 |
| 450° C./1 hr. | + 190° C./0.5 hr. | 52.2 | 47.6 | 5.71 |
| | + 190° C./2 hr. | 57.1 | 52.4 | — |

*SHT = Solution Heat Treatment
[a]= Tensile Strength (Ksi)
[b]= Yield Strength (Ksi)
[c]= % Elongation
** = This alloy was processed the same as the * alloy in Example 1 except the vacuum-hot-compaction was carried out at 300° C. resulting in a poorly compacted crumbly billet.

TABLE 2

| BAR | | UTS[a] | YS[b] | E[c] |
|---|---|---|---|---|
| | Al.2.34Li.1.07Zr | | | |
| | | (Longitudinal) | | |
| 500° C./1 hr. | + 180° C./10 m. | 61.5 | 55.5 | — |
| 500° C./1 hr. | + 190° C./2 hr. | 69.4 | 63.8 | 6.91 |
| 500° C./1 hr. | + 190° C./24 hr. | 61.4 | 53.3 | 5.22 |
| | | (Transverse) | | |
| 500° C./1 hr. | + 180° C./15 m. | 56.0 | 51.4 | 6.11 |
| 500° C./1 hr. | + 190° C./2 hr. | 64.3 | 60.7 | 5.60 |
| 500° C./1 hr. | + 190° C./24 hr. | 57.5 | 50.8 | 7.2 |
| | Al.2.18Li.0.12Zr | | | |
| | | (Longitudinal) | | |
| 500° C./1 hr. | + 190° C./0.5 hr. | 50.3 | 42.1 | 6.58 |
| 500° C./1 hr. | + 190° C./1 hr. | 52.4 | 45.5 | 4.51 |
| 500° C./1 hr. | + 190° C./24 hr. | 46.2 | 36.5 | 7.42 |
| | | (Transverse) | | |
| 500° C./1 hr. | + 190° C./0.5 hr. | 45.6 | 38.2 | 9.0 |
| 500° C./1 hr. | + 190° C./2 hr. | 49.0 | 41.4 | 9.29 |
| 500° C./1 hr. | + 190° C./24 hr. | 42.0 | 33.9 | 9.22 |

[a]= Tensile Strength (Ksi)
[b]= Yield Strength (Ksi)
[c]= % Elongation

Figure 3:
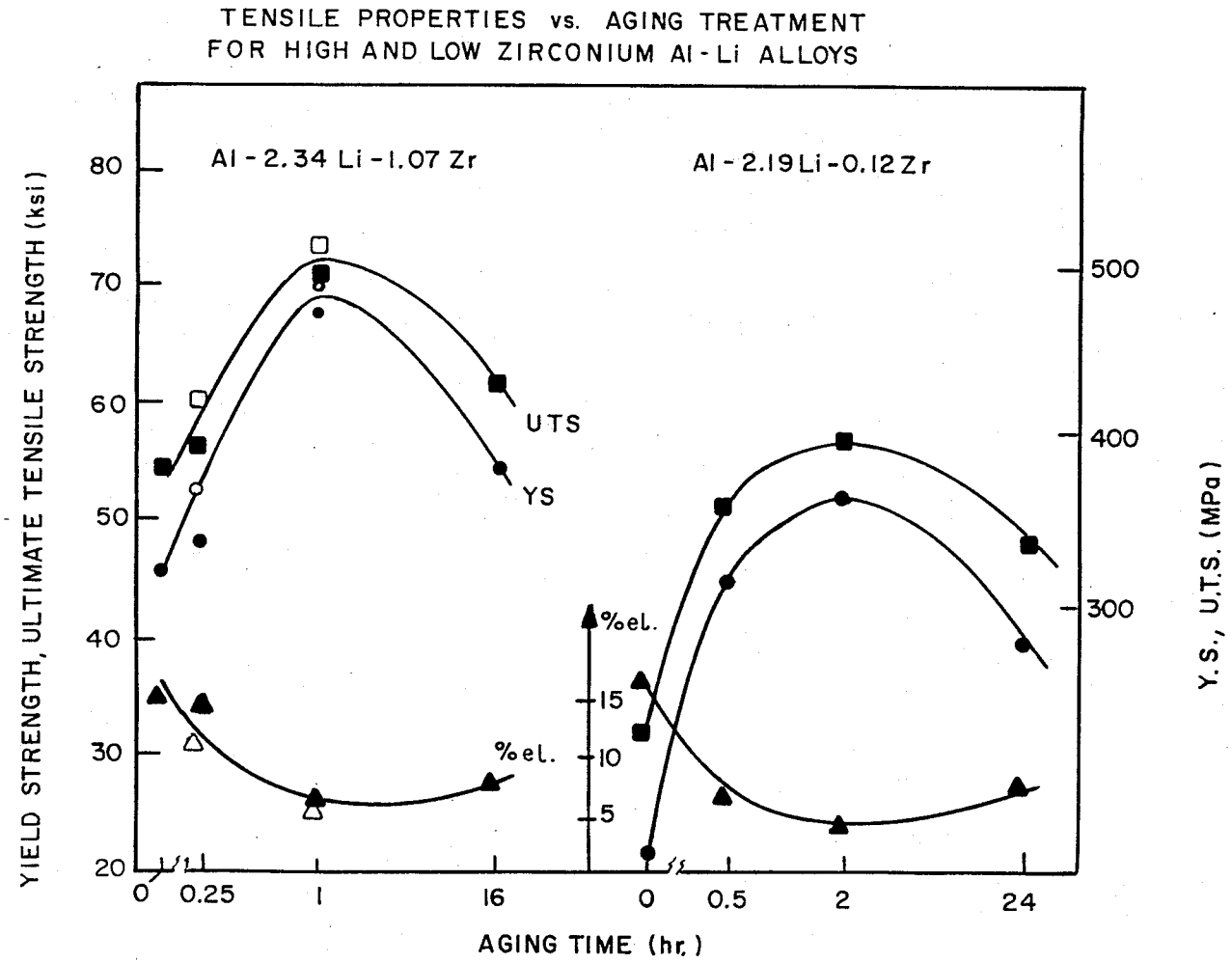
FIG. 3 illustrates variations in tensile properties as the aging treatment is changed for a rod of an Al.2.3-4Li.1.07Zr alloy and a rod of an Al.2.19Li.0.12Zr alloy.
Figure 4:
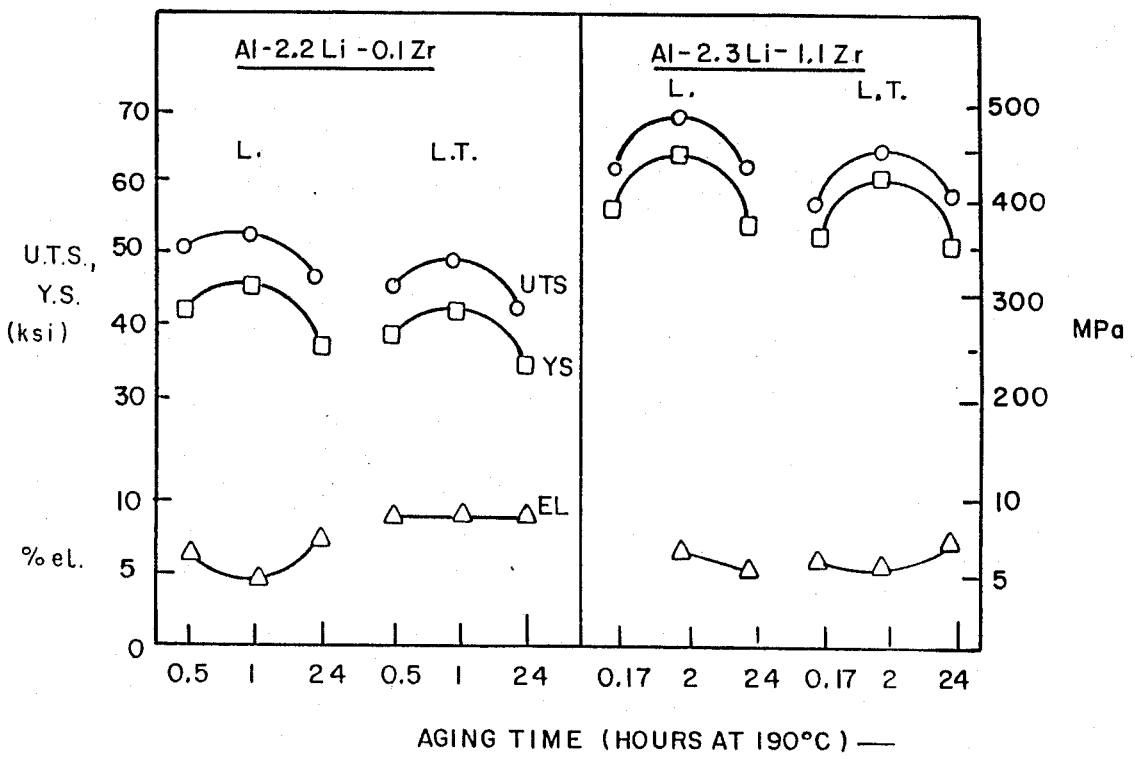
FIG. 4 represents variations in tensile properties as the aging treatment is changed for an bar of a Al.2.3-4Li.1.077Zr alloy and a bar of a Al.2.19Li.0.12Zr alloy in both the longitudinal and transverse directions.

The results of these tests are illustrated in FIGS. 3 and 4. FIG. 3 compares the high Zr rod with the low Zr rod for variations in tensile properties as the aging treatment is changed. FIG. 4 represents an analogous comparison for the high Zr bar and the low Zr bar in the longitudinal and transverse (long) direction. The results clearly show that the high Zr alloy consistently produces a far stronger Al.Li.Zr alloy.

Figure 5:
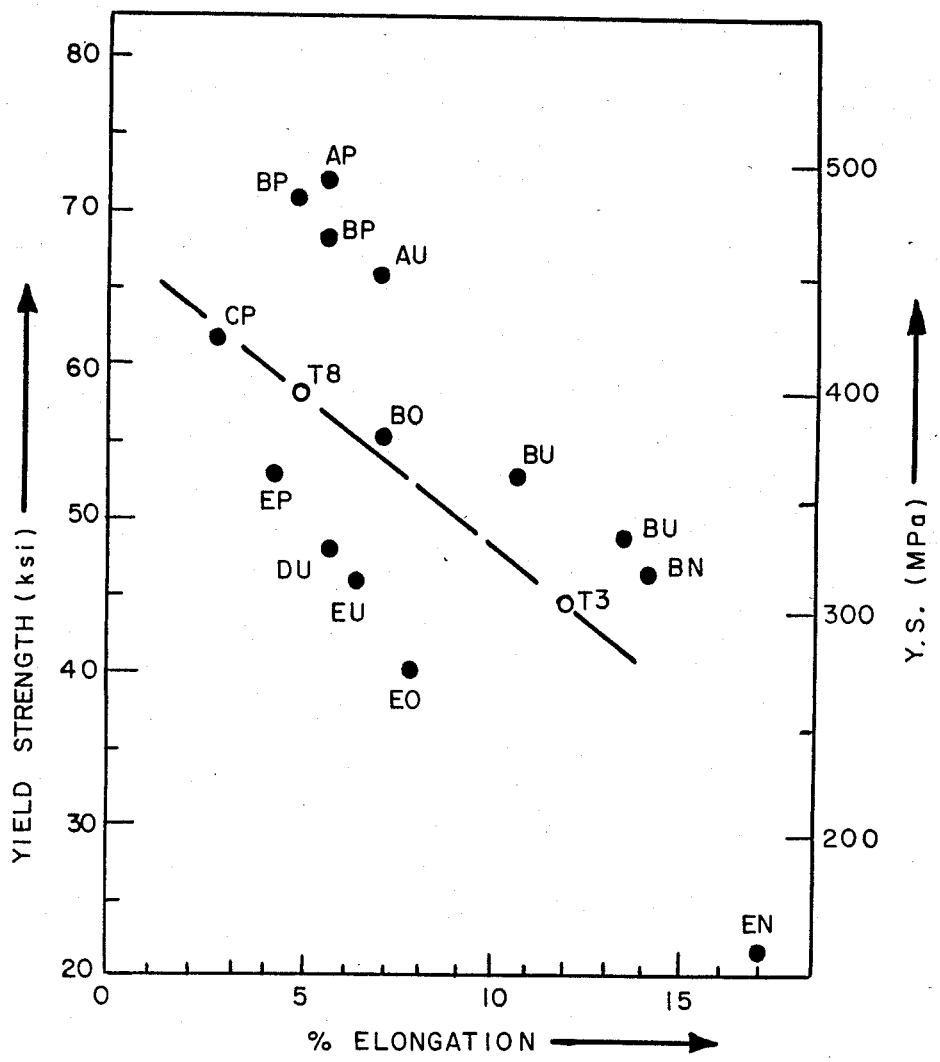
FIG. 5 illustrates the relationship between elongation and strength at specified conditions for an Al.2.3-4Li.1.07Zr alloy and an Al.2.19Li.0.12Zr alloy.

FIG. 5 shows the relationship between yield strength and percent elongation for the Al.2.34Li.1.07Zr alloy of the present invention and the Al.2.19Li.0.12Zr alloy of Example 2 under specified conditions. A standard commercial Al.Cu.Mg alloy sold under the tradename 2024/Al having the nominal composition Al.4.4Cu.1.5Mg.0.5Mn, has also been included for comparison. The points on Figures indicate the alloy, the solution heat treatment and the aging conditions used as follows:

A. Al.2.34Li.1.07Zr, Solution Heat Treated at 450° C./1 hr.
B. Al.2.34Li.1.07Zr, Solution Heat Treated at 500° C./1 hr.
C. Al.2.34Li.1.07Zr, Solution Heat Treated at 565° C./12 hrs.
D. Al.2.19Li.0.12Zr, Solution Heat Treated at 450° C./1 hr.
E. Al.2.19Li.0.12Zr, Solution Heat Treated at 500° C./1 hr.
N No Aging
U Under-aged
P Peak-aged
O Over-aged
T8 2024 alloy, Peak-aged
T3 2024 alloy, Under-aged Thus (.EP) indicates the low Zr alloy, with a solution heat treatment of 500° C./1 hr. and peak-aged was used. The results clearly indicate, for a given strength level the elongation is significantly greater for the high Zr alloy of this invention. Conversely for any given ductility level it is seen that the strength is much higher for the high Zr alloy than for the low Zr alloy.

Figure 6:
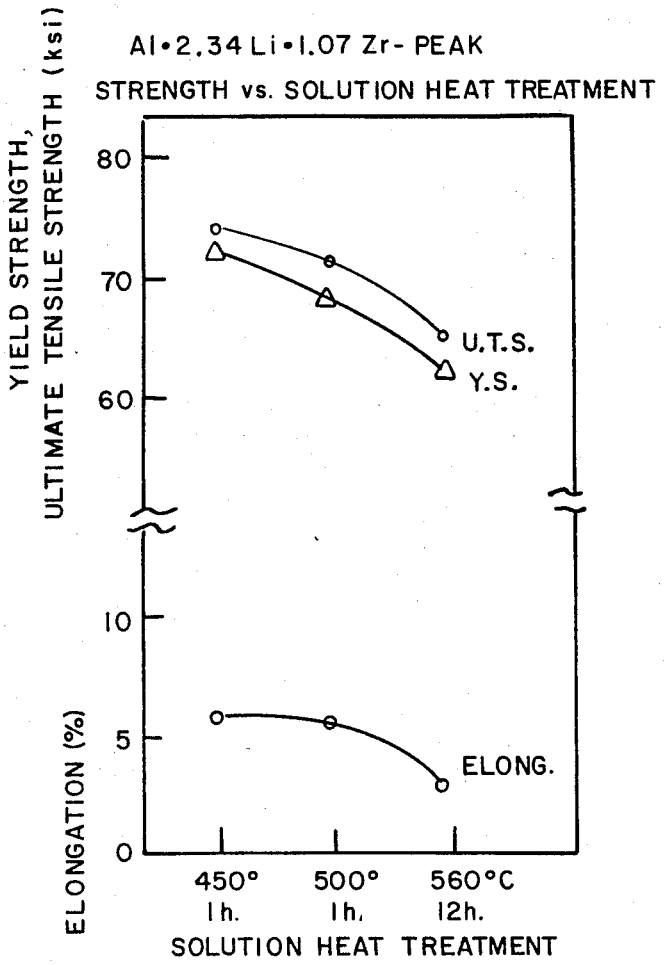
FIG. 6 illustrates the effect on the tensile properties of an Al.2.34Li.1.07Zr alloy when solution heat treatment is varied and the aging is held constant.
Figure 7:
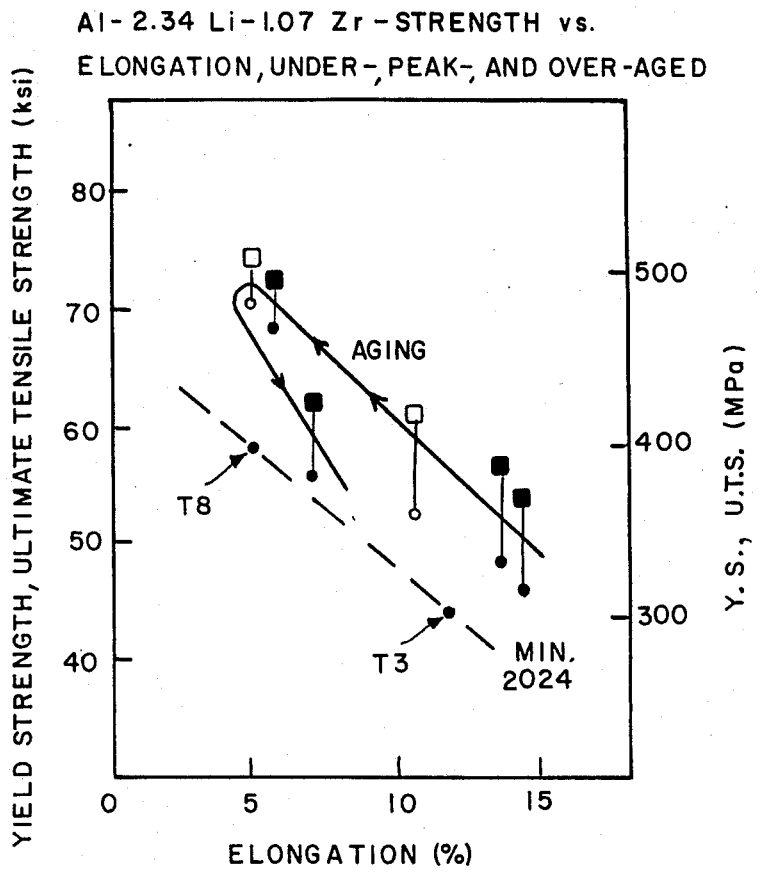
FIG. 7 illustrates the effect on the tensile properties vs. elongation for an Al.2.34Li.1.07Zr alloy, as aging proceeds from under-aged to peak-aged to over-aged conditions.

FIG. 6 illustrates the effect on the tensile properties of the high Zr alloy when the solution heat treatment (SHT) is varied and the aging is held constant. FIG. 7 shows the effect on the tensile properties of the high Zr alloy vs. elongation.

This invention has been described in detail including the preferred embodiments thereof. However, it is appreciated that those skilled in the art upon consideration of the present disclosure may make modifications and improvements within the spirit and scope of this invention.

I claim:

1. An alloy of the formula $Al_{bal}Li_bZr_c$ wherein, "b" represents about 1.9 through about 4.5 weight percent and "c" represents about 0.70 through about 4.0 weight percent formed by mixing Al metal with Li and Zr, heating the mixture in an inert atmosphere to a temperature sufficient to dissolve the Zr and Li in the molten Al, rapidly cooling the mixture, compacting and compressing the mixture of a temperature below 550° C., and extruding the mixture at a temperature between about 200°-350° C.; and heat-treating the alloy.

2. The alloy of claim 1 wherein "b" represents about 2.0 through about 3.5 weight percent and "c" represents about 0.90 through about 2.0 weight percent.

3. The alloy of claim 1 wherein "b" represents about 2.0 through about 2.5 weight percent and "c" represents about 0.9 through about 1.5 weight percent.

4. The alloy of claim 2 wherein the alloy contains less than 0.3 weight percent iron and less than 0.3 weight percent silicon as impurities.

5. The alloy of claim 4 wherein the alloy contains less than 0.5 weight percent hafnium as an impurity.

6. The alloy of claim 4 wherein the alloy contains less than 0.15 weight percent iron and less than 0.15 weight percent silicon as impurities.

7. The alloy of claim 6 wherein the alloy contains less than 0.1 weight percent hafnium as impurities.

8. The alloy of claim 3 wherein the alloy contains less than 0.3 weight percent iron and less than 0.3 weight percent silicon as impurities.

9. The alloy of claim 8 wherein the alloy contains less than 0.5 weight percent hafnium as an impurity.

10. The alloy of claim 3 wherein the alloy contains less than 0.15 weight percent iron and less than 0.15 weight percent silicon as impurities.

11. The alloy of claim 6 wherein the alloy contains less than 0.1 weight percent hafnium as impurities.

12. The alloy of claim 1 wherein "b" represents about 2.4 weight percent and "c" represents about 1.0 weight percent.

13. The alloy of claim 1 wherein "b" represents 2.34 weight percent and "c" represents about 1.07 weight percent.

14. An Al.Li.Zr alloy comprising a substantially Al matrix, at least about 0.90 weight percent Zr, and at least about 2.0 weight percent Li, having a precipitate of the formula $Al_3(Li_xZr_{1-x})$, $1>x\geqq0.1$, coated by $Al_3Li$.

15. The alloy of claim 14 wherein $0.8>x>0.2$.

16. The alloy of claim 14 wherein $0.8\geqq x\geqq0.4$.

17. A method of forming an Al—Li—Zr alloy which comprises:

(a) mixing Al metal with Li alloy and Zr, (b) heating the mixture in an inert gas atmosphere to a temperature sufficient to dissolve the Zr and Li in the molten Al:

(c) rapidly cooling the mixture and creating a solidified mass; and heat-treating the solidified mass at a temperature below about 550° C. in order to form a precipitate of the formula $Al_3(Li_xZr_{1-x})$ wherein $0.8.>x>0.1$.

18. The method of claim 17 which further comprises compacting the solidified mass into a billet.

19. The method of claim 17 wherein the heat treatment is carried out below 500° C.

20. The method of claim 18 wherein the heat treatment is carried out below 500° C.

21. The method of claim 17 wherein the rapid cooling is at least $10^2$° C./sec.

22. The method of claim 18 wherein the billet is compacted and compressed at a temperature below 550° C.

23. The method of claim 22 wherein the billet is compacted and compressed at a temperature below 350° C.

24. The method of claim 18 wherein the billet is then extruded at a temperature between about 200°-350° C.

* * * * *